US005630559A

United States Patent [19]

Bucken et al.

[11] Patent Number: 5,630,559

[45] Date of Patent: May 20, 1997

[54] DEVICE FOR LOCATING A FREE END OF YARN WOUND ON A COP

[75] Inventors: Rene Bucken, Grefrath; Helmut Kohlen, Erkelenz; Guido Mirbach, Kerken, all of Germany

[73] Assignee: W. Schlafhorst AG & Co., Moenchengladbach, Germany

[21] Appl. No.: 513,277

[22] Filed: Aug. 10, 1995

[30] Foreign Application Priority Data

Aug. 10, 1994 [DE] Germany ..... 44 28 245.1

[51] Int. Cl.[6] ..... B65H 69/04; B65H 63/00; D01H 5/28

[52] U.S. Cl. ..... 242/35.6 E; 57/279; 242/36

[58] Field of Search ..... 242/35.6 E, 35.5 A, 242/36; 57/261, 262, 279, 280

[56] References Cited

U.S. PATENT DOCUMENTS

| | | | |
|---|---|---|---|
| 3,373,551 | 3/1968 | Gillono et al. | 57/262 |
| 3,905,186 | 9/1975 | Harmon et al. | 57/262 |
| 5,037,036 | 8/1991 | Okuyama | 242/35.6 E |
| 5,058,816 | 10/1991 | Schreiber | 242/35.6 E X |
| 5,170,953 | 12/1992 | Stahlecker | 242/35.6 E X |
| 5,288,030 | 2/1994 | Wirtz et al. | 242/35.6 E X |

FOREIGN PATENT DOCUMENTS

| | | |
|---|---|---|
| 0 322 008 B1 | 11/1988 | European Pat. Off. . |
| 0 322 008 A1 | 11/1988 | European Pat. Off. . |
| 26 12 660 A1 | 4/1977 | Germany . |
| 39 18 788 A1 | 12/1989 | Germany . |
| 39 30 935 A1 | 3/1991 | Germany . |
| 40 25 003 A1 | 2/1992 | Germany . |
| 45 15814 | 12/1965 | Japan . |
| 48-29818 | 9/1973 | Japan . |

*Primary Examiner*—Michael Mansen
*Attorney, Agent, or Firm*—Shefte, Pinckney & Sawyer

[57] ABSTRACT

A device for searching for the yarn end on the conical windings of textile yarn cops increases the dependability of the detection of the position of the conical windings by providing a nozzle element in the yarn grasping mechanism for contacting the conical windings and whose position can be changed in relation to a sensor-controlled lifting mechanism. A sensor is arranged on the yarn grasping mechanism to detect a position change of the nozzle element relative to the lifting mechanism caused by contact of the nozzle element with the conical windings. The sensor is electrically connected with the drive of the lifting mechanism. The nozzle element, which advantageously is of a tubular bell-shaped configuration having a conical interior configuration, can be displaced coaxially to the longitudinal axis of the cop in an end of the yarn grasping mechanism which can be moved by the lifting mechanism. A marking, which can be easily recognized by the sensor, is placed on the displaceable nozzle element.

12 Claims, 5 Drawing Sheets

DEVICE FOR LOCATING A FREE END OF YARN WOUND ON A COP

FIELD OF THE INVENTION

The present invention relates generally to a device for locating a yarn end at the upper end of a textile cop, commonly formed in a conical shape and typically referred to as the cop cone, and relates more particularly to a device wherein yarn grasping elements can be placed at a predeterminable distance against the cop cone, whose position in height possibly can vary from cop to cop, by means of a sensor-controlled lifting mechanism.

BACKGROUND OF THE INVENTION

It can become necessary to search for the leading free end of yarn being wound in the production of cops in a ring spinning frame as well as during further processing of the cops in a bobbin winding machine. While in a ring spinning frame the yarn connection for continuing the spinning process is produced directly, it is the conventional practice in a bobbin winding machine to perform a so-called complete cop preparation. In the process, the located yarn end is placed on the cop in a manner such that it can be easily located and grasped again later at a winding station.

In a ring spinning frame, the yarn end rests against the cop cone after a yarn break, since the progressive placement of yarn windings always takes place directly on the cop cone and advances therefrom in the direction of the cop nose. Accordingly, with each yarn break the height of the cop cone varies as a function of the state of completion of winding of the cop.

In bobbin winding machines, the yarn end of cops coming directly from the spinning frame has usually been deposited as a so-called overwinding or underwinding in the area of the bobbin foot or the bobbin tip and must be located and grasped at that location. However, so-called residual cops (i.e. cops having a usable amount of yarn but being less than fully wound) are also ejected from the winding stations if a yarn break on the cop has occurred during unwinding of the yarn or if the yarn connection was not reestablished after a yarn break during spinning, such as is the case in connection with conventional spinning frames being produced today. As a rule, the yarn end of these residual cops is also located on the cop cone which, depending on the state of unwinding of the cop, can also be disposed at a different level. Finally, there is also the possibility that cops are delivered to the winding machine by the ring spinning frame which are not fully wound because of the occurrence of a batch change.

It is necessary in all of the aforementioned cases to position yarn releasing or yarn grasping elements so that their distance from the cop cone is always of the same dimension and so that a high degree of success is assured in the yarn search. Lifting mechanisms for the yarn grasping elements are provided for this purpose.

Sensors which detect the position of the cop cone must be provided for appropriately triggering the lifting mechanisms. Photo-optical sensors are known to serve this purpose and, together with the yarn grasping elements, are moved along the longitudinal axis of cops by the lifting device.

Sensors of this type operate on the basis of reflections by measuring the light reflected by the bobbin surface. When associated light beams enter the area of the cop cone, the light is clearly more scattered, which can be detected by means of an appropriately disposed photo-optical sensor (for example, see Japanese Patent Publication JP-AS 45 15 814).

Disadvantageously, however, because of the displacement of the yarn layers on the bobbin, a clear detection of the start of the cop cone is no longer possible. In contrast, the detection of the position of the cop cone is improved if a photoelectric barrier spaced apart from the bobbin is utilized as the sensor, since it is directly disrupted by the cop cone. Such a solution is known for example from German Patent Publication DE 26 12 660 A1 and European Patent Publication EP 0 322 008 B1.

A photo-optical sensor system is both relatively expensive and furthermore not reliable over time, since soiling occurs on the surface of the optical element because of the dust typically created by the conventional textile operations, which can lead to errors in the detection of the cop cone.

SUMMARY OF THE INVENTION

It is accordingly an object of the present invention to provide an improved device for locating the yarn end at the upper conical yarn windings of cops which achieves greater reliability in the detection of the position of the cop cone.

Briefly summarized, this objective is achieved in accordance with the present invention by equipping a device for locating a yarn end at the conical upper yarn windings on a textile yarn cop with a yarn grasping means for placement at a predetermined spacing from the conical windings and a lifting means for moving the yarn grasping means toward and away from the conical windings. The yarn grasping means includes a nozzle element configured for contact with the cop cone and supported to be movable relative to the lifting means and a sensor disposed to detect a change in the position of the nozzle element relative to the lifting means upon contact of the nozzle element with the conical windings. The sensor, in turn, is operatively connected with the lifting means for control thereof.

The determination of a positional change of the nozzle element when brought into contact with the cop cone can be performed considerably more simply and more reliably than an optical process for the direct determination of the starting point of the cop cone. Above all, it then advantageously becomes possible to utilize sensors, which could not be used in connection with the direct positional determination of the cop cone. More specifically, it is possible to provide a marking on the movable element which can be detected by an appropriate sensor.

A particularly simple embodiment results if the nozzle element for contacting the cop cone is displaceably disposed in an end piece of the yarn grasping element which can be moved coaxially with the longitudinal axis of the cop by the lifting mechanism. With an appropriate design of the mating surfaces of the nozzle element and the end piece to slide with respect to one another, the sliding of the nozzle element in the end piece results in a trouble-free transfer of movement.

A tubular bell-like configuration of the nozzle element permits its use also as the yarn grasping element. For this purpose, the end piece can be connected to a vacuum source. The range of movement of the nozzle element within the end piece can be limited by providing stops on the end piece. If the sensor is fixedly disposed in the end piece, a marking on the displaceable nozzle element can be easily detected by this sensor. A metallic marking on the nozzle and a Hall sensor are an advantageous pairing.

Following the contact of the displaceable nozzle element with the cop cone, it is possible to continue to move the end piece practically unhampered further in the direction of the longitudinal axis of the cop because of the sliding connection of the nozzle element within the end piece. As a result of this relative movement, the marking on the displaceable nozzle element approaches the sensor on the end piece, which continues to signal having reached the cop cone.

One possibility for reacting to the sensor signal is to reverse the drive of the lifting mechanism and to retract the end piece by a predefined amount which should be preset so that, by means of a lower stop on the end piece, the end piece slightly lifts the bell-shaped nozzle element off the cop cone by a small distance, producing a predefined annular gap between the conical inner wall of the nozzle element and the cop cone. If suction air is then applied, a relatively strong air flow is created through this gap which assures a high degree of probability for loosening the yarn end from the cop cone.

A second possibility is to design the displaceable nozzle element such that by switching on suction air the nozzle element is aspirated against the upper stop of the end piece. It is sufficient for this purpose if the drive of the lifting device is only stopped following the sensor signal.

Without attempting to specifically describe further conceivable variants, it should be noted that the displaceable nozzle element in accordance with the present invention can also merely have the function of exciting a sensor or may itself be a sensor in the form of a mechanical switch.

DETAILED DESCRIPTION OF THE PREFERRED EMBODIMENTS

The present invention will be herein described with respect to a cop preparation device in a bobbin winding machine and the description will be limited to the process and mechanical arrangement for loosening or grasping the yarn. Further steps of depositing the yarn end on the cop for subsequent location thereof in the winding station can take place, for example, at a subsequent processing station, which therefore is not represented herein. For such purpose, the grasped yarn end also can be shortened to an appropriate length by a device for cutting the yarn to size, also not shown. At the same time, it is to be understood that the instant invention does not preclude aspirating or blowing the located yarn end into the cop tube at the same station. Furthermore, other components for assisting the yarn loosening process are conceivable, like for example blower nozzles or components which act mechanically on the cop surface. However, since the present invention relates particularly to the exact detection of the position of the cop cone, the description of the exemplary embodiments of the invention is similarly limited for purposes of simplicity.

Figure 1:
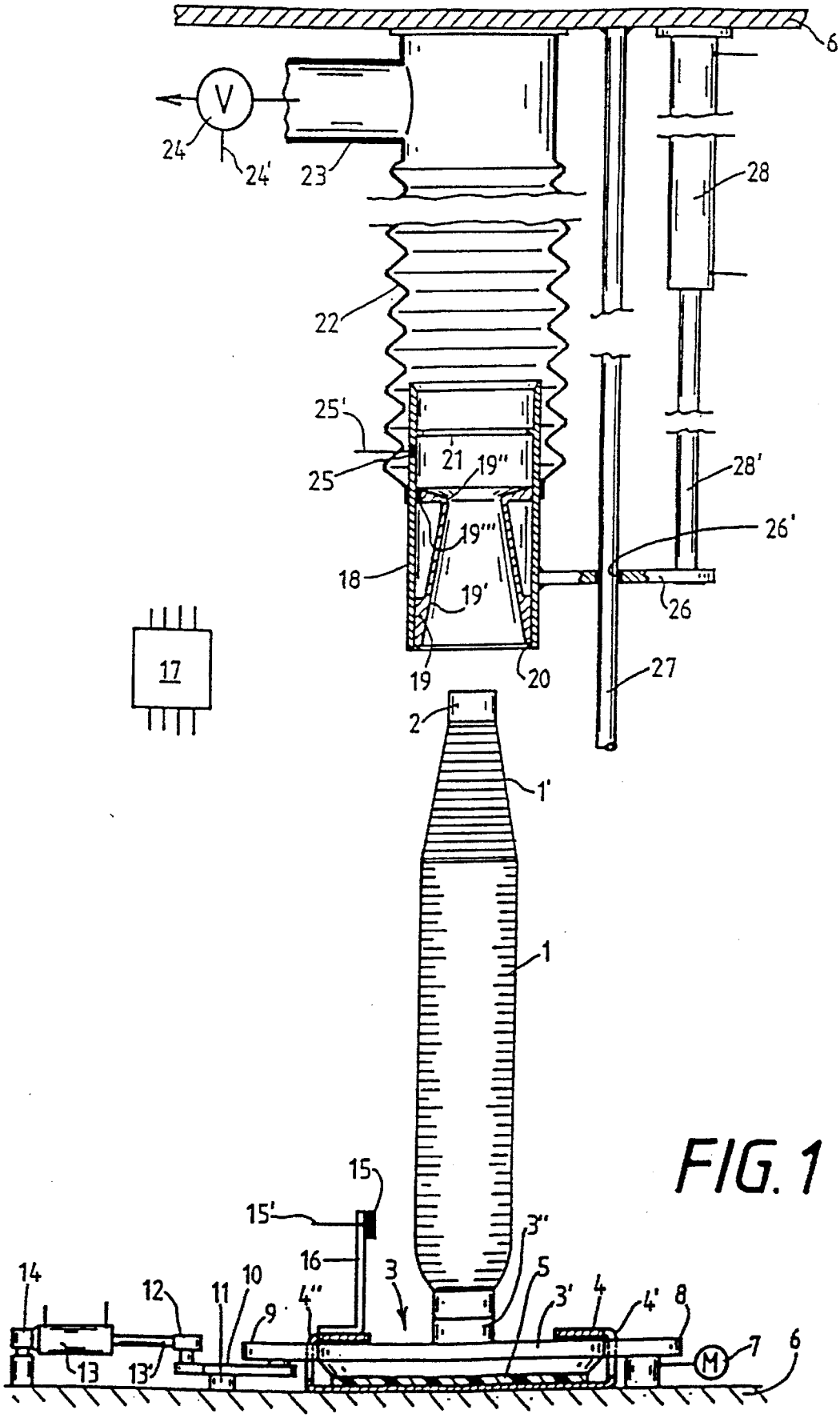
FIG. 1 is a side elevational view of a device for locating a yarn end on the cop cone of a cop stopped on a conveying path.

Referring now to the accompanying drawings and initially to FIG. 1, a cop 1 is illustrated with the lower end of its yarn tube supported about an arbor 3" upstanding from the base 3' of a caddy 3 resting on a conveyor belt 5. This caddy 3 is transported on the conveyor belt 5 by means of frictional contact between the belt 5 and the base 3' of the caddy 3 while under the guidance of a guide channel 4 extending laterally alongside the belt 5. A sensor 15 is disposed on a holder 16 at the guide channel 4 and is connected with a control unit 17 by means of a signal line 15' to detect the arrival of a cop 1 and then report this information to the control unit 17 via the signal line 15'. The control unit 17, in turn, causes the cop 1 and the caddy 3 on which the cop 1 is placed to be stopped by actuating a fluid cylinder 13 fastened on a stand 14. A joint 12 is disposed on the end of the piston 13' of the fluid cylinder 13 and is connected with one end of a plate 10 which is pivoted around a bolt 11 fastened on the machine frame 6, one or more pressure rollers being 9 supported on the opposite end of the plate 10 from the joint 12. The pressure rollers 9 can thereby be extended through an opening 4" in the guide channel 4 to engage directly on the base 3' of the arriving caddy 3. An opening 4' is disposed on the opposite side of the guide channel 4, through which a friction wheel 8 driven by a motor 7 can similarly extend.

In this manner, the friction wheel 8 and the pressure rollers 9 cooperate to position the caddy 3 as well as the cop 1 placed thereon and, in addition, can generate a rotating movement of the cop 1 around its longitudinal axis. By way of example, such a drive device is disclosed in German Patent Publication DE 40 25 003 A1.

A yarn grasping device, which is displaceable along the longitudinal axis of the cop 1 by means of a lifting mechanism, is disposed above the cop 1 when positioned in the described manner. The grasping device includes a tube-shaped end piece 18 connected with one end of a bellows 22 which, in turn, is connected by its other end with a suction air connector 23. As a very simple embodiment of the aforementioned lifting mechanism, the end piece 18 is fastened on a holder 26 formed with a bore 26 which receives a guide rod 27 affixed to depend from the machine frame 6 for sliding displacement of the holder 26 along the guide rod 27 for moving the end piece 18 upwardly and downwardly relative the cop 1 by the action of a piston 28' of a fluid drive cylinder 28 affixed to the holder 26.

A suction nozzle 19, of a tubular configuration open at its opposite ends and of a conically tapered interior forming an overall bell-like shape, is supported within the end piece 18 to be displaceable in alignment with the longitudinal cop axis between two annular stops 20 and 21. A Hall sensor 25 is attached to the end piece 18 and is connected via a signal line 25' with the control unit 17. The suction nozzle 19 is provided with a metallic marking 19"', which is vertically aligned with the sensor 25.

The suction air connector 23 is connected with a valve 24 which can be controlled via a control line 24' by the control unit 17. In the opened state, this valve 24 connects the bellows 22 and, in turn, the end piece 18 and its nozzle 19 with a vacuum source through suction air connector 23 fastened on the machine frame 6.

In the representation of FIG. 1, the end piece 18 as well as the associated elements are shown to be disposed in an initial elevated position in which a cop 1 can be conveyed along the guide channel 4 without the upper nose end of its yarn tube colliding with the end piece 18.

When the caddy 3 with the cop 1 has reached an operative position underneath the end piece 18 and is stopped therein by the rollers 8,9, as described above, the control unit 17 triggers the fluid cylinder 28 to extend the piston 28' and thereby displace the holder 26 and the end piece 18 fastened thereon along the guide rod 27.

Figure 2:
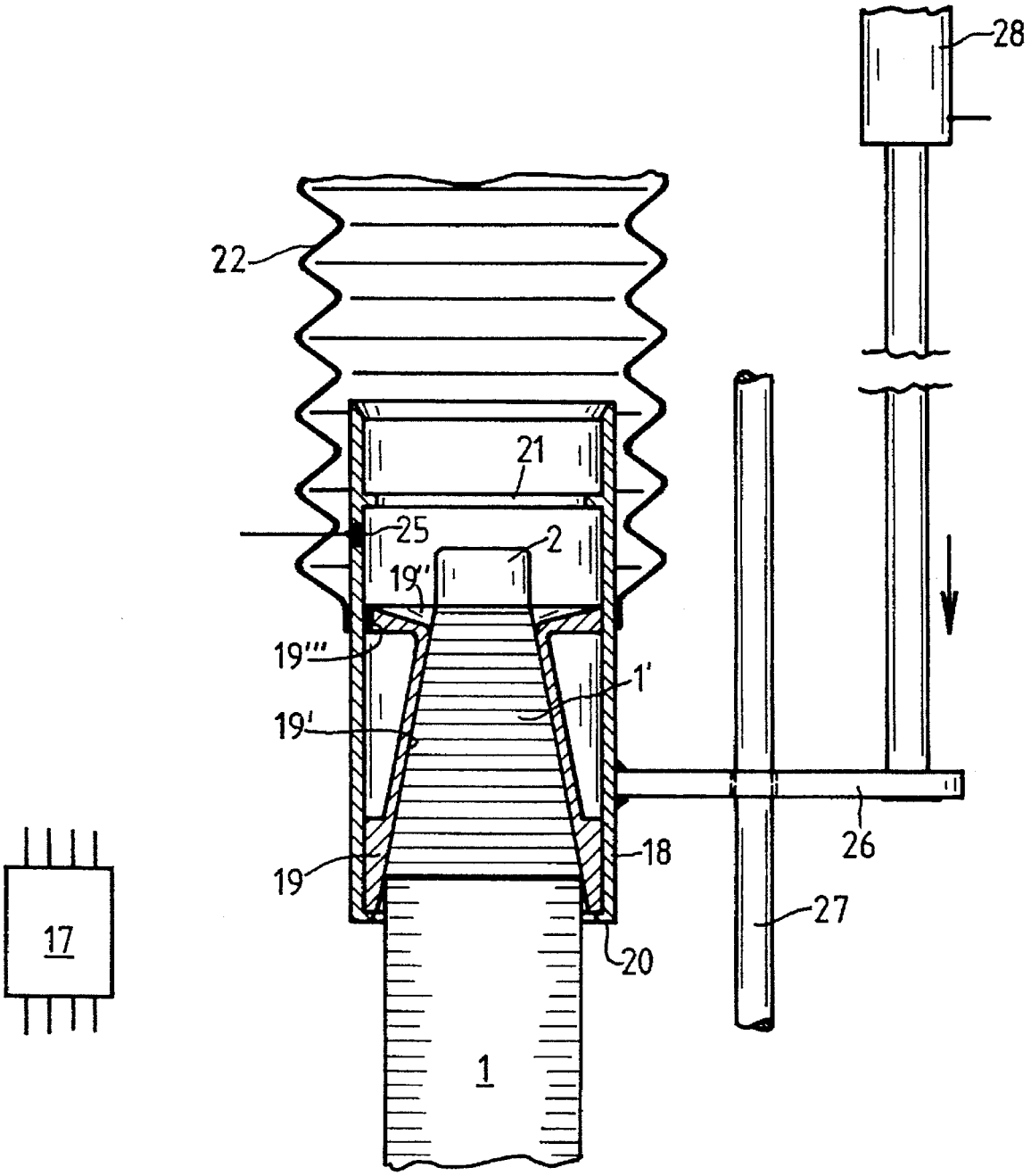
FIG. 2 is another side elevational view showing a portion of the device of FIG. 1, but in a subsequent phase of movement.
Figure 3:
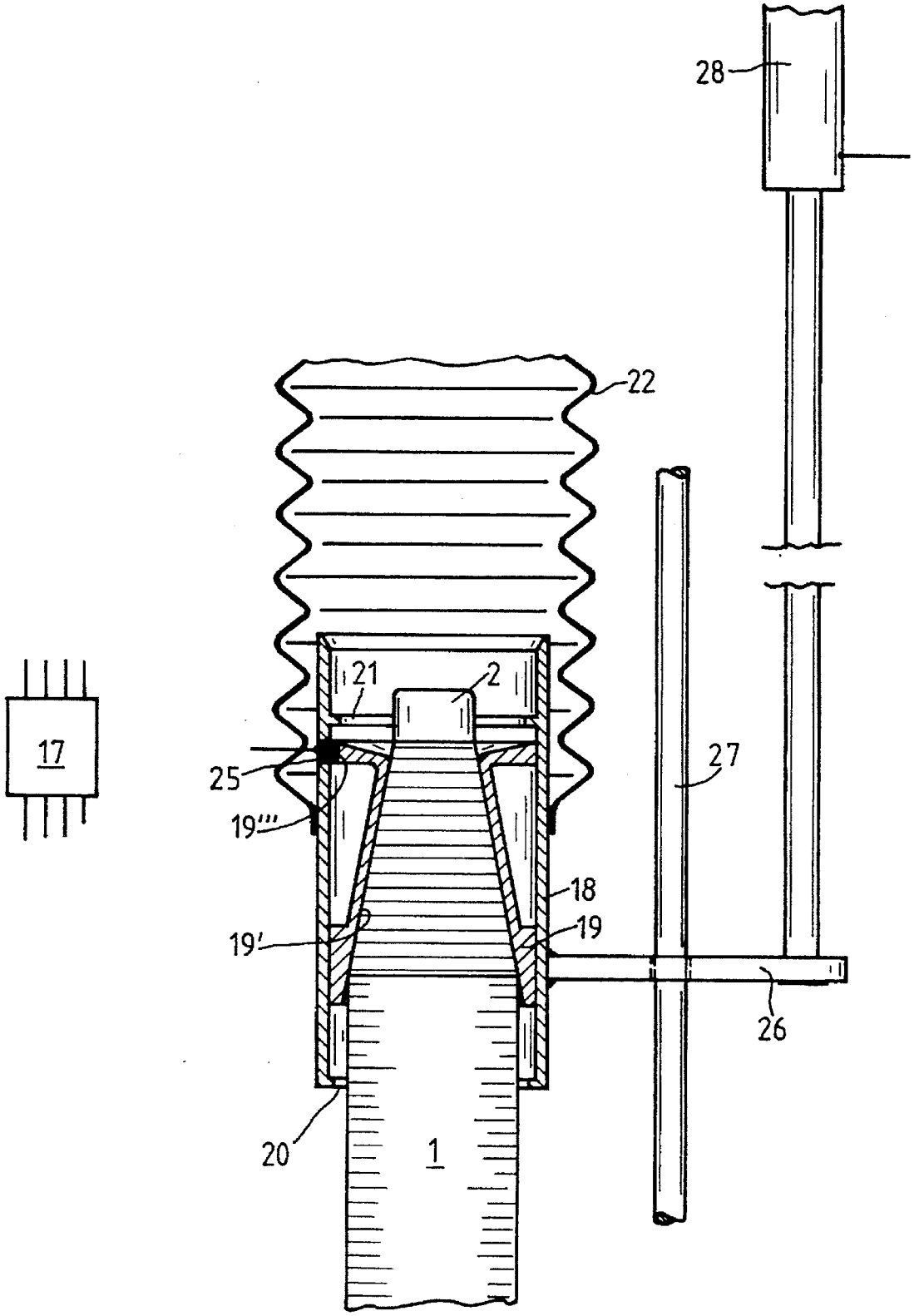
FIG. 3 is another side elevational view similar to FIG. 2, showing a representation of a further phase of movement.
Figure 4:
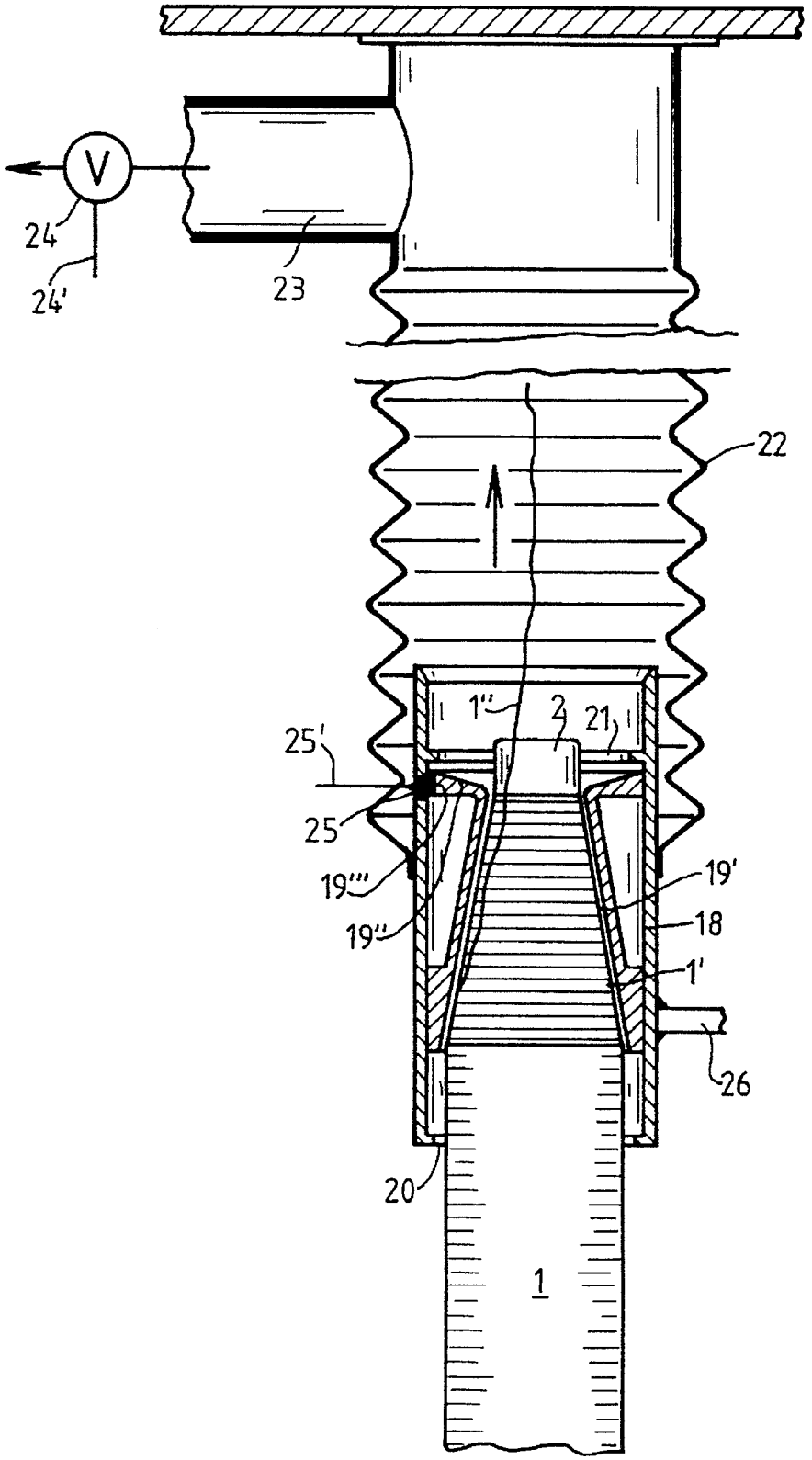
FIG. 4 is a further side elevational view of the device of FIGS. 1–3, showing a phase of movement following the representation in FIG. 3.

As can be seen in FIG. 2, this displacement movement continues until the conical interior surface 19' of the suction nozzle 19 comes into contact with the conical upper portion 1' of the yarn windings on the cop 1. With a continued advancing movement of the end piece 18, the suction nozzle 19, which originally rested on the lower annular stop 20, slides in the direction toward the upper annular stop 21. As represented in FIG. 3, in the course of this movement, the metallic marking 19''' passes the Hall sensor 25 which transmits a signal to the control unit 17 via the signal line 25' indicating that the suction nozzle 19 has reached this position underneath the end piece 18, thereby providing a precise indication regarding the position of the cop cone 1'. Directly thereafter, the lifting motion of the end piece 18 is stopped, leaving the edge of a funnel-shaped upper neck 19" of the suction bell 19 at a defined distance from the upper stop 21. Following the stoppage of the end piece 18, the valve 24 is opened via the control line 24', which as aforementioned establishes a connection with the suction air generator. As a result, the suction nozzle 19 resting on the cop cone 1' is further lifted under the influence of the suction air force until its funnel-shaped upper neck 19" contacts the upper stop 21, and in the process, a defined gap results between the cone-shaped interior surface 19' of the suction nozzle 19 and the cop cone 1' through which the suction air flows rapidly to act on the entire circumference and almost the entire length of the cop cone 1', all as represented in FIG. 4. In this manner, a starting end of the yarn 1" lying on the cop cone 1' can easily be grasped and aspirated into the bellows 22. In the present case, this grasping is additionally aided by simultaneous turning of the cop 1.

The continuous opening extending through the interior of the suction nozzle 19 between the cone-shaped interior surface 19' and the funnel-shaped neck 19" must be of a sufficient diameter appropriately exceeding the diameter of the yarn tube of the cop 1 to allow the tube to pass therethrough as well as to leave a sufficient distance from the tube surface for continuing the suction flow. However, the size of this opening should also be restricted so as to appropriately limit the gap between the cop cone 1' and the cone-shaped interior surface 19'. If possible, it is desirable to maintain a constant gap width over the entire length of the cop cone 1'.

Figure 5:
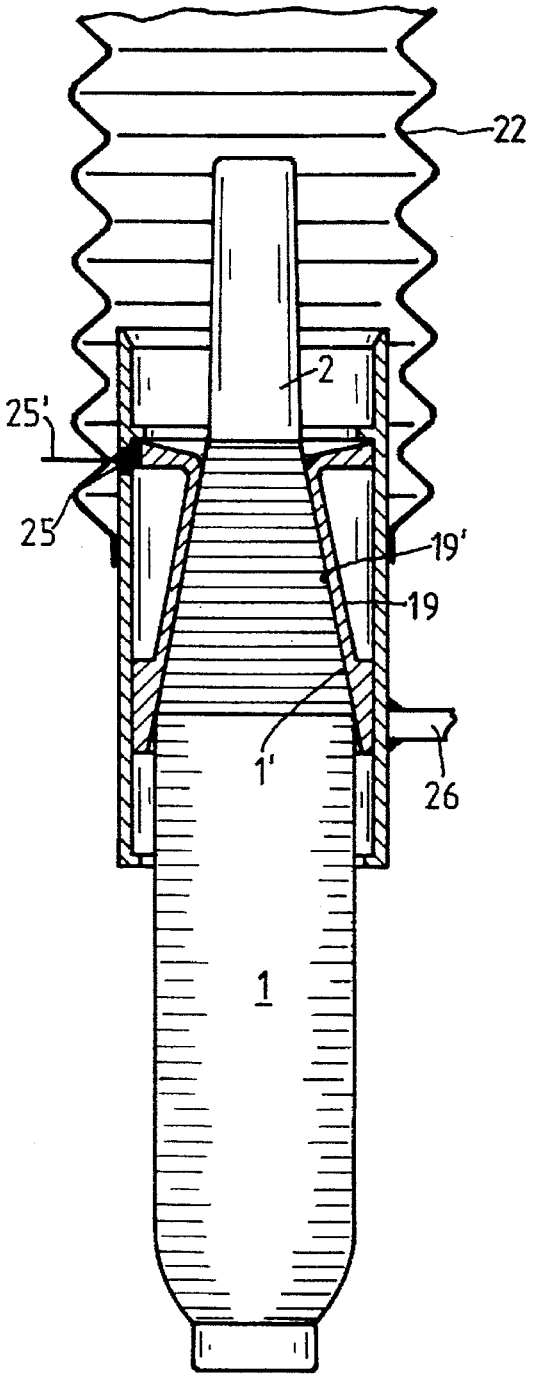
FIGS. 5 and 6 are side elevational views similar to FIGS. 2–4, showing a device of an alternative embodiment in two phases of movement.
Figure 6:
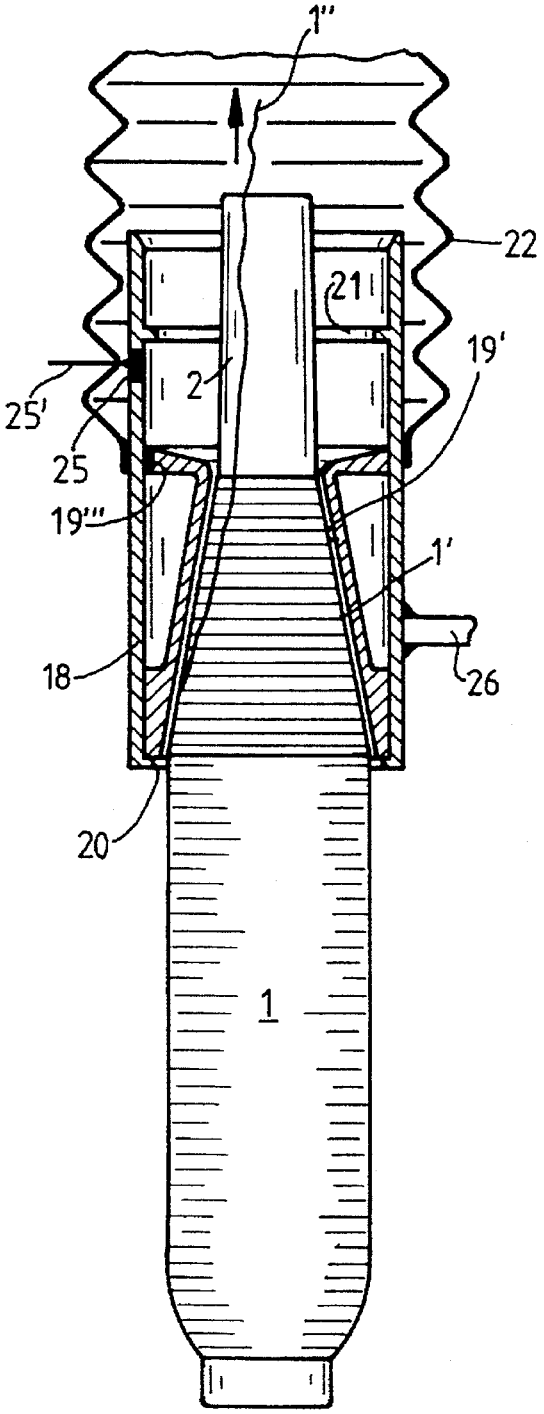

In an alternative embodiment represented in FIGS. 5 and 6, the end piece 18 is illustrated as having already been lowered into engagement with the cop sufficiently to have elevated the suction nozzle 19 by engagement with the cop cone 1' to bring the marking 19''' on the end piece past the Hall sensor 25, so that the position of the cop cone 1 has been detected (FIG. 5).

In this second embodiment, it can be seen that the cop cone 1' is situated at a lower position along the yarn tube than is represented in the first embodiment of FIGS. 1–4, thus representing a partially unwound cop having residual yarn windings, for example, while the first embodiment may, for example, represent a fully wound cop 1 which could not be prepared in a first preparation device for freshly spun cops because, for example, the starting end of the yarn may not have been present as a nose winding or foot winding at one end of the cop tube and instead may be disposed directly on the cop cone. Thus, as will be understood, since conventional preparation devices for freshly spun cops directly search for the starting end of the yarn at the bobbin foot, the bobbin nose and on the surface of the cop, the yarn end would not be located by means of such a preparation device if the starting end of the yarn is located on the cop cone 1'.

As can be seen in FIG. 6, the end piece 18 is subsequently lifted again by a distance sufficiently to bring the stop 20 into engagement with the end piece 18 to produce a slight lifting of the suction nozzle 19 by the stop 20. Hereagain, it is possible to create a defined air gap between the suction nozzle 19 and the cop cone 1' because of the previous exact determination of the position of the cop cone 1' by means of the Hall sensor 25 and the presetting of the distance by which the end piece 18 is thereafter moved upwardly. In this case, the suction air needs only to be switched on when the position of the end piece 18 and the suction nozzle 19 shown in FIG. 6 has been reached. Thus, in this second embodiment, it is not necessary to lift the suction nozzle 19 by means of suction pressure through the bellows 22 in order to create the defined gap between the suction nozzle 19 and the cop cone 1'.

Hereagain, it should be noted that a fluid cylinder 28 has been shown only as a simplified representation of one possible lifting mechanism. Those persons skilled in the art will readily understand that any other appropriate drive means may be substituted if a more exact positioning of the end piece is desired. One such exemplary drive means is described in German Patent Application DE 40 25 003 A1, by way of example. Drives such as used in the prior art mentioned above are also possible.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A device for locating a yarn end at the conical upper yarn windings on a textile yarn cop, comprising:

a yarn grasping mechanism for placement at a predetermined spacing from the conical windings and a lifting mechanism for moving the yarn grasping mechanism toward and away from the conical windings, the yarn grasping mechanism including a nozzle element configured for contact with cop cone and supported to be movable relative to the lifting mechanism, a controller for controlling movement of the lifting mechanism, and a sensor disposed to detect a change in the position of the nozzle element relative to the lifting mechanism upon contact of the nozzle element with the conical windings, the sensor communicating with the controller.

2. A device in accordance with claim 1, wherein the yarn grasping mechanism is disposed for movement coaxially in respect to a longitudinal axis of the cop by the lifting mechanism, and the nozzle element is displaceably disposed within an end of the yarn grasping mechanism.

3. A device in accordance with claim 2, further comprising a vacuum source connected to the end of the yarn grasping mechanism, and wherein the end of the yarn grasping mechanism is tubular.

4. A device in accordance with claim 1, wherein the nozzle element is tubular with a conical interior configuration.

5. A device in accordance with claim 1, wherein the yarn grasping mechanism comprises stops to limit the range of movement of the nozzle element.

6. A device in accordance with claim 1, wherein the sensor is fixed to the yarn grasping mechanism.

7. A device in accordance with claim 6, wherein the sensor comprises a Hall sensor and the nozzle element has a marking which can be detected proximately by the Hall sensor.

8. A device in accordance with claim 1, wherein the sensor is operative to deactuate the lifting mechanism upon detection of a positional change of the nozzle element during a lowering movement of the lifting mechanism and subsequently to actuate reversal of the lifting mechanism over a predetermined distance.

9. A device in accordance with claim 1, further comprising a vacuum source and a valve connecting the vacuum source with the yarn grasping mechanism, and wherein the sensor is operative to deactuate the lifting mechanism upon detection of a positional change of the nozzle element during a lowering movement of the lifting mechanism and to actuate the valve to open the vacuum source to the yarn grasping mechanism.

10. A method of finding a yarn end at the conical upper yarn windings on a textile yarn cop comprising the steps of:

lowering a tubular end piece of a yarn grasping device including an element slidably disposed therein onto the cop for engagement of the element with the conical upper yarn windings of the cop;

stopping said lowering of the end piece when the element is displaced a predetermined distance within the end piece upon contact of the element with the conical upper yarn windings;

creating a gap between the element and the conical upper yarn windings; and aspirating the yarn end on the conical upper yarn windings by applying an air suction within the end piece to create an air flow through the gap.

11. A method according to claim 10, further comprising the step of engaging the element with substantially the entire upper yarn conical windings of the cop during said lowering of the tubular end piece.

12. A device for locating a yarn end at the conical upper yarn windings on a textile yarn cop, comprising:

a yarn grasping mechanism for placement at a predetermined spacing from the conical windings and a lifting mechanism for moving the yarn grasping mechanism toward and away from the conical windings, the yarn grasping mechanism including an element configured for contact with the cop cone and supported to be movable relative to the lifting mechanism, a controller for controlling movement of the lifting mechanism, and a sensor disposed to detect a change in the position of the element relative to the lifting mechanism upon contact of the element with the conical windings, the sensor communicating with the controller.

* * * * *